US005509548A

United States Patent [19]

Kreher

[11] Patent Number: 5,509,548

[45] Date of Patent: Apr. 23, 1996

[54] COUPLING HEAD HOUSING OF A CENTRAL BUFFER COUPLING

[75] Inventor: Joachim Kreher, Braunschweig, Germany

[73] Assignee: Scharfenbergkupplung GmbH, Salzgitter, Germany

[21] Appl. No.: 366,609

[22] Filed: Dec. 30, 1994

[30] Foreign Application Priority Data

Jan. 28, 1994 [DE] Germany ..... 44 02 530.0

[51] Int. Cl.[6] ..... B61G 7/06; B61G 3/00

[52] U.S. Cl. ..... 213/77; 213/93; 213/100 W

[58] Field of Search ..... 213/77, 93, 95, 213/100 R, 100 W, 220, 88, 89, 101

[56] References Cited

U.S. PATENT DOCUMENTS

| | | | |
|---|---|---|---|
| 2,161,724 | 6/1939 | Scharfenberg | 213/77 |
| 3,405,811 | 10/1968 | Cope | 213/100 W |
| 3,655,066 | 4/1972 | Metzger | 213/100 W |
| 4,375,857 | 3/1983 | Gunther et al. | 213/77 |
| 4,627,545 | 12/1986 | Herbert et al. | 213/100 R |

FOREIGN PATENT DOCUMENTS

| | | |
|---|---|---|
| 662874 | 6/1938 | Germany . |
| 2926301 | 1/1988 | Germany . |

*Primary Examiner*—Robert J. Oberleitner
*Assistant Examiner*—Kevin D. Rutherford
*Attorney, Agent, or Firm*—McGlew and Tuttle

[57] ABSTRACT

A coupling head housing of a central buffer coupling for rail vehicles, especially low-platform vehicles, with a lock with rotatable disk-type hook and articulated coupling ring, which is located retracted inside the centering projection when the coupling is not in use, and with a funnel for receiving the centering projection of an opposite coupling head of the same design. Offsets in height and lateral offsets, but even angular offsets are to be compensated prior to the coupling process. Accordingly, the front part, which combines a compact design with the known advantages of older coupling designs for the largest possible gripping range, within which a coupling process can still be initiated as intended when the coupling head housings are axially offset in relation to one another and it can be concluded after the adjustment to one another.

7 Claims, 2 Drawing Sheets

COUPLING HEAD HOUSING OF A CENTRAL BUFFER COUPLING

FIELD OF THE INVENTION

The present invention pertains to a coupling head housing of a central buffer coupling for rail vehicles, especially a coupling head housing of small dimensions, e.g., for low-platform vehicles, which has a vertical front surface, a rotatable disk-type hook lock and an articulated coupling ring, which is located retracted inside a centering projection when the coupling is not in use, wherein the centering projection, located on one side of the front surface, has an inner lateral surface facing the vertical central longitudinal plane of the coupling head housing as an oblique inner guide surface, in which this inner guide surface as well as the outer lateral surface taper into an elongated, vertically extending, cam-like cone tip, and a funnel, which extends into the inside of the coupling head housing and is symmetrical to the centering projection, is provided on the other half of the front surface for receiving the centering projection of an opposite coupling head of the same design, so that two guides are formed by the inner guide surfaces and the inner strip of the projecting centering projection for coupling an opposite coupling head housing.

BACKGROUND OF THE INVENTION

Such a coupling head housing has been known from German Patent No. DE 662,874 and German Patent No. DE 29,26,301.

Accurate axial alignment between two central buffer couplings of two rail vehicles moving toward one another is not practically guaranteed under field conditions before the interlocking. This is due, on the one hand, to the condition of the track, and, on the other hand, to the condition of the vehicle. Therefore, vertical and lateral offsets, but also angular offsets are to be compensated prior to l;he coupling process. To specify an offset of two central buffer couplings, which deviates from the correct axial alignment and must not be exceeded if proper coupling is to be achieved, a so-called gripping range, within which a coupling process can still be initiated as intended and can be concluded after the adjustment to one another, is specified.

To increase the gripping range, German Patent No. DE 662,874 proposes, e.g., that a guide horn be arranged as a guide on the funnel side and that an inner strip be arranged as a second guide on the projecting centering projection. However, the hazard potential of a projecting guide horn is considered to be too high for certain vehicles, e.g., street-cars, because these vehicles are also operated in a flow of traffic.

The central buffer coupling disclosed in German Patent No. DE 29,26,301 has no guide horn on the coupling housing, and it has an inner guide surface on the centering projection to extend the gripping range. Based on its design, this coupling is specifically designed for railroad vehicles without limitations in terms of the dimensions.

SUMMARY AND OBJECTS OF THE INVENTION

The basic task of the present invention is therefore to propose a coupling head housing for central buffer couplings, in which the largest possible gripping range is achieved, while the advantages of prior-art couplings are advantageously incorporated, for use in a design in which limited dimensions, especially small height dimensions, are imposed, such as in the case of low-platform vehicles.

According to the invention, a coupling head housing of a central buffer coupling for rail vehicles, especially a coupling head housing of small dimensions, e.g., for low-platform vehicles is provided which has a vertical front surface, a rotatable disk-type hook lock and an articulated coupling ring, which is located retracted inside a centering projection when the coupling is not in use. The centering projection, located on one side of the front surface, has an inner lateral surface facing the vertical central longitudinal plane of the coupling head housing as an oblique inner guide surface, in which this inner guide surface as well as the outer lateral surface taper into an elongated, vertically extending, cam-like cone tip, and a funnel, which extends into the inside of the coupling head housing and is symmetrical to the centering projection, is provided on the other half of the front surface for receiving the centering projection of an opposite coupling head of the same design. Two guides are formed by the inner guide surfaces and the inner strip of the projecting centering projection for coupling an opposite coupling head housing. The cone tip and the corresponding deepening of the funnel are displaced toward the vertical central longitudinal plane a of the coupling head housing. The respective distance A of the cone tip and the corresponding deepening of the funnel from the longitudinal plane a is approximately ⅔of the horizontal distance B between the vertical central longitudinal plane a and the respective opposite side of the centering projection or of the funnel. The height C of the centering projection and tile maximum opening of the funnel corresponding to this height are less than 1 cm smaller than the horizontal distance B. The amount of projection D of the centering projection in front of the front surface is approximately 0.65 times the height C, and the fulcrum point of the coupling lock is located at a distance E, which is approximately 0.47 times the height C, from the front surface in the vertical central longitudinal plane a of the coupling head. The extension of the greatest width and height of the centering projection and the funnel are equal.

The inner guide surface of the centering projection is preferably joined by two deflecting surfaces, which extend, symmetrically to the horizontal transverse plane b of the coupling head housing above and under the recess, for the passage of the coupling ring over a length F each. This approximately corresponds at least to the opening G of the recess for the passage of the coupling ring at the cone tip of the centering projection, and they begin at a distance H from the front surface, which is smaller than or equal to half the length F. The cone tip of the centering projection, which has a radius between 20 mm and 30 mm, drops upward and downward at an oblique angle K of 5°–25° relative to the vertical. The entry bevel on the top side and the lower side of the centering projection has an angle L, which is preferably markedly within the limits for the bevel of the cone tip. The funnel preferably has an entry bevel of at least 1 min.

Due to the arrangement of the tip of the cone and the corresponding deepening of the funnel toward the center of the coupling head, the center of gravity of the coupling connection is placed in the longitudinal axis of the vehicle. The design is compact and not projecting toward the sides. The dimensions specified guarantee uniform horizontal and vertical sliding of the cone into the funnel.

The deflecting surfaces on the inner guide surface of the centering cone are needed for, e.g., cable couplings, so that the centering of the cable couplings can take place after the centering of the coupling rather than in the reversed order.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One exemplary embodiment of the present invention is shown in the drawing, and it will be explained in greater detail below. The drawing figures show simplified schematic representations, which are not true to scale.

In the drawings.

DETAILED DESCRIPTION OF THE PREFERRED EMBODIMENTS

Figure 1:
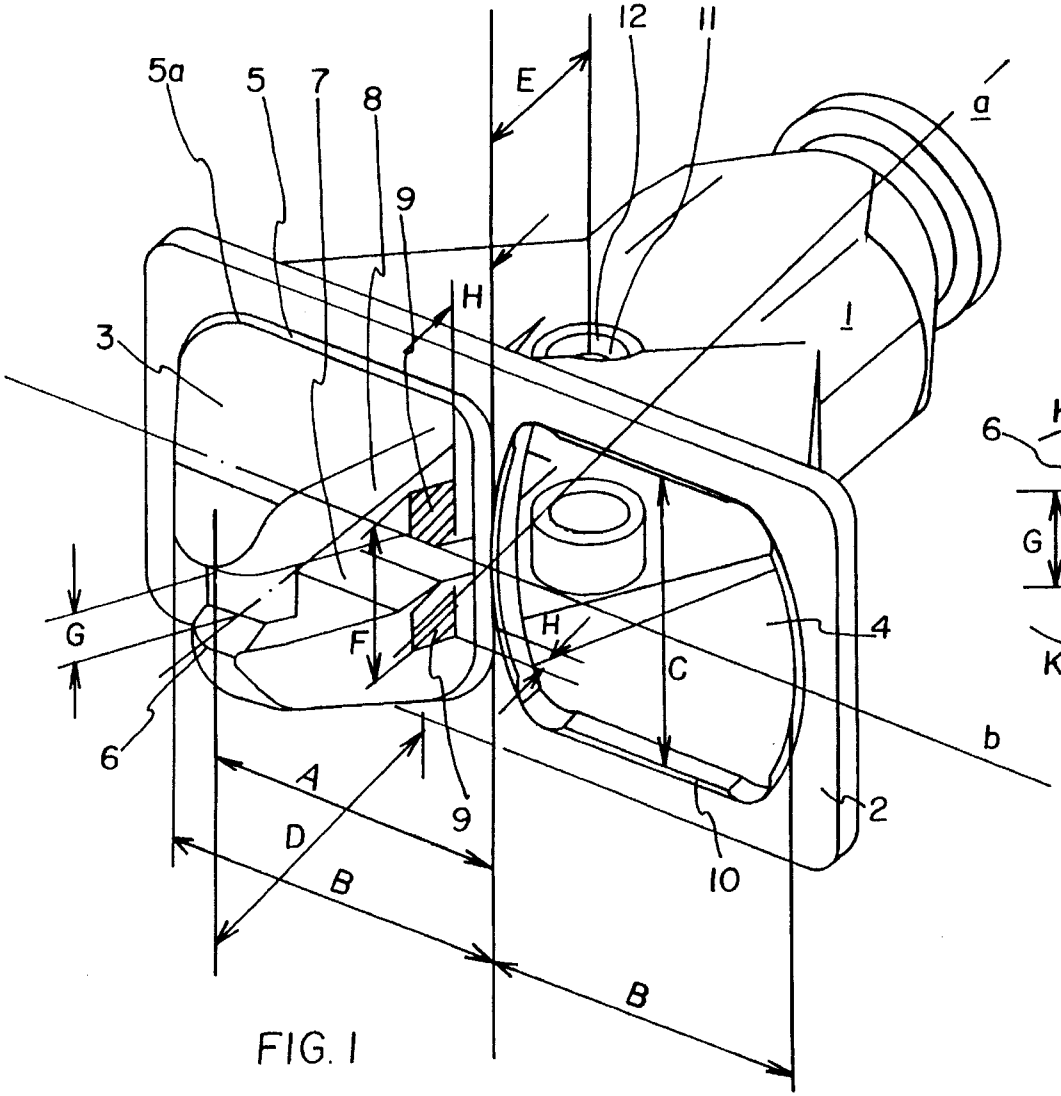
FIG. 1 is a perspective oblique view of a coupling head with the front surface located in the forward direction.

As is shown in FIG. 1, a coupling head housing 1 carries on its front surface 2 a centering projection 3 and has a funnel 4. The funnel 4 is for receiving the centering projection of an opposite coupling head housing at the same distance from the vertical central longitudinal plane a as the centering projection 3 on the other half of the front surface 2.

Starting from the front surface 2, the centering projection 3 has an approximately square, partially oval centering surface 5. Centering surface 5 has an inner strip 5*a*, which is joined by the forwardly tapering part of the centering projection 3 with the cone tip 6. A recess 7 is located in the cone tip 6. The centering recess 7 contains in the known manner, a coupling ring (not shown), which is located retracted inside the centering projection 3,. Deflecting surfaces 9 for the fine centering of the centering projection in an opposite coupling funnel are located above and under the recess 7 symmetrically to the horizontal central transverse plane b on the inner guide surface 8 of the centering projection 3 located toward the center of the coupling.

The funnel 4 has entry bevels 10 on its edge.

A bolt 11 is provided with an upper support point in the housing 1, which is located behind the front surface 2 in the central longitudinal plane a. This upper support point forms the fulcrum point 12 of the coupling lock. The upper support point is also shown on the coupling head housing 1.

In the exemplary embodiment according to the present invention, the distance between the cone tip 6 and the central longitudinal plane a is distance A. Distance A equals ⅔of distance B, in which B is the dimension between the central longitudinal plane a and the outer edge of the funnel 4 or of the centering projection 3, so that the center of gravity of the centering projection 3 is at a closely spaced location from the center of the coupling. The distance B between the center of the coupling or the central longitudinal plane a and the respective opposite side of the centering projection 3 or the funnel 4 has a dimension between 170 and 180 mm. Correspondingly, C, which is tile height of the centering projection 3 or the maximum vertical opening of tile funnel 4, can be greater than 160 mm and smaller than 180 mm, and the distance E can be in the range of 75 mm to 85 mm.

Figure 2:
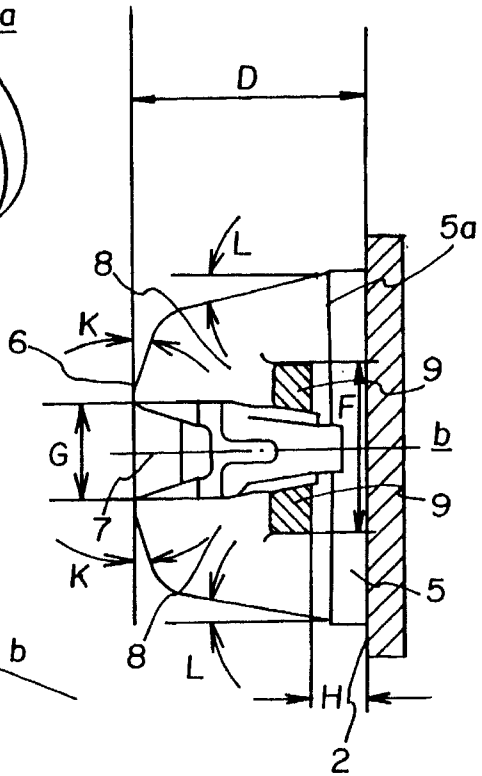
FIG. 2 is a side view of a centering projection in a section in the vertical central longitudinal plane a, and FIG. 3 is a front view showing the gripping range of a coupling head of a central buffer coupling according to the present invention.

FIG. 2 shows the design and the dimensions of the centering projection 3, which is symmetrically divided by the central transverse plane b into an upper section and a lower section, and b extends centrally through the recess 7. The largest opening G of the recess 7 is located on the cone tip 6 and has a dimension of 40 to 50 mm. The extension or length F of the two deflecting surfaces 9 on the inner guide surface 8 is correspondingly 80 mm to 100 mm, and the distance H from the front surface 2 is smaller than or equal to 25 mm.

The oblique angles on the cone tip 6 are designated by L, and those on tile top side and the lateral side of the centering projection 3 are designated by K.

The amount of projection D of the cone tip 6 in front of the front surface is between 104 mm and 117 mm. At its junction to the front surface 2, the centering projection 3 has the centering surface 5 with the inner strip 5*a*, into which the recess 7 partially extends.

Figure 3:
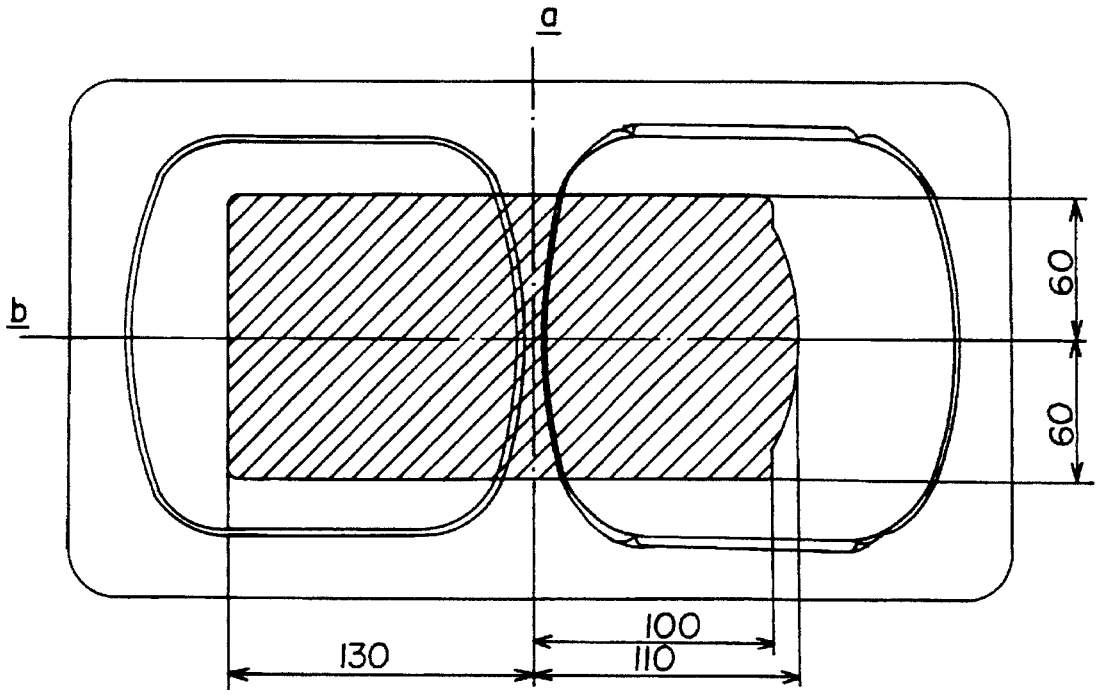

The gripping range of a central buffer coupling shown in FIG. 3, which equals at least 100 mm on both sides and 60 mm upward and downward, is achieved with the dimensions indicated. It is seen that there is a rectangular gripping range for at least 100 mm of deflection to the side. The gripping range is equal above and under the central plane b, which is achieved due to the fact that the front surface 2 of the coupling head 1 has a completely symmetrical design in these directions of extension.

For deflections to the left, coupling is possible even in the case of a 130 mm lateral offset. If the vertical offset does not reach the maximum possible value of 60 mm, but it is in the range of up to 20 mm, coupling is also still possible in the case of a lateral offset by 110 mm to the right.

While a specific embodiment of the invention has been shown and described in detail to illustrate the application of the principles of the invention, it will be understood that the invention may be embodied otherwise without departing from such principles.

What is claimed is:

1. A coupling head housing of a central buffer coupling for rail vehicles, the coupling head housing having a coupling lock and an articulated coupling ring, the coupling head housing comprising: a vertical front surface; a centering projection, located on one side of said front surface, said centering projection having an inner lateral surface facing a vertical central longitudinal plane of the coupling head housing and having an outer lateral surface, said outer lateral surface defining an oblique inner guide surface, said inner guide surface vertical central longitudinal plane as well as said outer lateral surface taper into an elongated, vertically extending, cam-like cone tip; a funnel extending into an inside of said coupling head housing, said funnel being symmetrical to said centering projection, said funnel being provided on another side of said front surface for receiving a centering projection of an opposite coupling head of a same design, so that guides are formed by said inner guide surface of said projecting centering projection for coupling an opposite coupling head housing, said cone tip and a corresponding deepening portion of said funnel being displaced toward a vertical central longitudinal plane a of the coupling head housing, so that a distance A from said cone tip to said vertical central longitudinal plane a and a distance A from said deepening portion to said vertical central longitudinal plane a is approximately ⅔of a horizontal distance B between said vertical central longitudinal plane a and an opposite side of said centering projection and a horizontal distance B between said vertical central longitudinal plane a and an opposite side of said funnel deepening portion; a height C of said centering projection and a height of an opening of said funnel corresponding to said height C are less than 1 cm smaller than said horizontal distance B; an amount of projection D of said centering projection in front of said front surface is approximately 0.65 times said height C, and a fulcrum point of the coupling lock is located at a distance E, which is approximately 0.47 times said height C, from said front surface in said vertical central longitudinal plane a of said coupling head.

2. Coupling head housing in accordance with claim 1, wherein said cone tip of said centering projection has a radius between 20 mm and 30 ram, said cone tip dropping upward and downward at an oblique angle K of 5°–25° relative to said vertical, an entry bevel being provided on a top side and a lower side of said centering projection, said entry bevel having an angle L, which is preferably markedly within said limits for said bevel of said cone tip.

3. Coupling head housing in accordance with claim 2, wherein said funnel has an entry bevel of at least 1 min.

4. Coupling head housing in accordance with claim 4, wherein said funnel has an entry bevel of at least 1 min.

5. Coupling head housing in accordance with claim 1, wherein said inner guide surface of said centering projection is joined by two deflecting surfaces, said deflecting surfaces extending symmetrically to said horizontal transverse plane b of the coupling head housing above and under a recess for passage of said coupling ring, each of said deflecting surfaces extending over a length F each, which approximately corresponds at least to an opening G of said recess for said passage of said coupling ring, said deflecting surfaces beginning at a distance H from said front surface, said distance H being smaller than or equal to half said length F.

6. Coupling head housing in accordance with claim 2, wherein said cone tip of said centering projection has a radius between 20 mm and 30 mm, said cone tip dropping upward and downward at an oblique angle K of 5°–25° relative to said vertical, an entry bevel being provided on a top side and a lower side of said centering projection, said entry bevel having an angle L, which is preferably markedly within said limits for said bevel of said cone tip.

7. A coupling head housing in accordance with claim 1, wherein an extension of greatest width and height of said centering projection and said funnel are equal.

* * * * *